US012319978B2

(12) United States Patent
Zheng et al.

(10) Patent No.: US 12,319,978 B2
(45) Date of Patent: Jun. 3, 2025

(54) SEALED COBALT LEACHING DEVICE, REAGENT FOR COBALT LEACHING, METHOD USING DEVICE, USE OF METHOD

(71) Applicant: Sichuan Jiarui Technology Co., Ltd., Sichuan (CN)

(72) Inventors: Yu Zheng, Chongqing (CN); Nian Liu, Jiangsu (CN); Lijuan Cao, Hebei (CN); Weiming Li, Hubei (CN)

(73) Assignee: Sichuan Jiarui Technology Co., Ltd., Chengdu (CN)

( * ) Notice: Subject to any disclaimer, the term of this patent is extended or adjusted under 35 U.S.C. 154(b) by 814 days.

(21) Appl. No.: 17/531,710

(22) Filed: Nov. 20, 2021

(65) Prior Publication Data

US 2022/0235435 A1 Jul. 28, 2022

Related U.S. Application Data

(63) Continuation of application No. PCT/CN2021/098389, filed on Jun. 4, 2021.

(30) Foreign Application Priority Data

Jan. 22, 2021 (CN) ..... 202110086761.3

(51) Int. Cl.
*C22B 3/00* (2006.01)
*C22B 3/02* (2006.01)
(Continued)

(52) U.S. Cl.
CPC ..... *C22B 23/0438* (2013.01); *C22B 3/02* (2013.01); *C22B 3/065* (2013.01); *C22B 3/10* (2013.01); *C22B 23/0423* (2013.01)

(58) Field of Classification Search
USPC ..... 422/255, 261
See application file for complete search history.

(56) References Cited

U.S. PATENT DOCUMENTS 5,459,074 A * 10/1995 Muoni ..... C10M 175/0091 436/60
2010/0095602 A1* 4/2010 Belnap ..... C04B 35/52 51/309

FOREIGN PATENT DOCUMENTS

CN 105156037 A 12/2015
CN 109179396 A 1/2019
(Continued)

OTHER PUBLICATIONS

CN 110565094 A Machine Translation, originally published Dec. 23, 2019, translation generated Dec. 5, 2024 (Year: 2019).*

*Primary Examiner* — Keith D. Hendricks
*Assistant Examiner* — Nikolas Takuya Pullen
(74) *Attorney, Agent, or Firm* — Nitin Kaushik

(57) ABSTRACT

Disclosed are a sealed cobalt leaching device, a reagent for the cobalt leaching, a method using the device, and use of the method. The sealed cobalt leaching device includes a base, where a top of the base is provided with a first groove; a chemical solution holding tool is provided above the base; a bottom of the chemical solution holding tool is removably connected to the base; a holding through-hole penetrating up and down is formed inside the chemical solution holding tool; and a sealing cover is provided above the chemical solution holding tool. Beneficial effects of the present disclosure: Through the combination of the base, the chemical solution holding tool, and the sealing cover, the holding through-hole inside the chemical solution holding tool is sealed, thereby improving the cobalt leaching temperature and the cobalt leaching efficiency.

9 Claims, 3 Drawing Sheets

(51) Int. Cl.
*C22B 3/06* (2006.01)
*C22B 3/10* (2006.01)

(56) References Cited

FOREIGN PATENT DOCUMENTS

| | | | |
|---|---|---|---|
| CN | 110565094 | A | 12/2019 |
| WO | 2002024601 | A1 | 3/2002 |

* cited by examiner

SEALED COBALT LEACHING DEVICE, REAGENT FOR COBALT LEACHING, METHOD USING DEVICE, USE OF METHOD

CROSS REFERENCE TO RELATED APPLICATIONS

The present application is a Continuation Application of PCT Application No. PCT/CN2021/098389 filed on Jun. 4, 2021, which claims the benefit of Chinese Patent Application No. 202110086761.3 filed on Jan. 22, 2021. All the above are hereby incorporated by reference in their entirety.

TECHNICAL FIELD

The present disclosure relates to the field of leaching of cobalt, and in particular to a sealed cobalt leaching device, a reagent for the cobalt leaching, a method using the device, and use of the method.

BACKGROUND

As a key working component for crude oil and natural gas exploitation and as a material that directly interacts with a rock structure for shearing and crushing, a polycrystalline diamond (PCD) composite material plays a decisive role in the drilling efficiency of the overall drill bit. Due to the extreme properties of underground drilling conditions, a PCD composite layer needs to have the optimal material properties to achieve exploitation tasks, including extremely high hardness, toughness, and thermal stability. The arrangement of carbon atoms in the diamond itself provides a PCD composite layer with ultra-high hardness; a micro-grain boundary of polycrystalline bonding and a network structure of a metal catalyst existing among micro-scale grains provide a PCD composite layer with necessary toughness; with the continuous improvement of drilling technology and equipment level, a rotational speed of a drill bit, and a pressure at a tip of a drill bit, unprecedented requirements are put forward for the thermal stability of a PCD composite layer that is in direct contact with a rock surface and works at a high pressure and high speed. In a high-temperature and high-pressure synthesis process of a PCD composite material, transition metals of the group VIII elements are usually used as catalysts to reduce a temperature and a pressure required for the formation of a diamond crystal phase, so as to achieve an engineering technical index level that can be achieved by the prior pressing machine, thus completing the entire synthesis process. However, a transition metal element penetrated into a PCD material will cause local stress concentration in actual drilling applications due to the different coefficient of thermal expansion (CTE) thereof from a diamond body and has phase transition catalysis properties itself, when a temperature reaches 700° C. under normal pressure, a diamond phase will be catalytically converted into a graphite phase that is more stable under normal pressure, which will seriously reduce the thermal stability of the PCD composite material.

WO 02/24601 A1 has disclosed a patent, where a PCD composite material is subjected to surface treatment by chemical method to dissolve and precipitate metal elements in the material and improve the overall thermal stability of the PCD composite material. This patent was widely accepted by the crude oil and natural gas drilling industry and has been in use ever since. This patent will officially expire in 2021, at which point this technology will be completely opened, such that the surface treatment of a PCD composite material will become a consensus of the entire industry. However, the method and specific control level of surface treatment are about to become new technical competition points.

With the above-mentioned continuous improvement of drilling technology and performance requirements, requirements on the hardness, toughness, and thermal stability of a diamond composite layer in the entire industry have also increased significantly. Polycrystalline diamond compact (PDC) manufacturers improve the process conditions of a high-temperature and high-pressure synthesis process to improve the hardness and toughness of a composite layer and greatly improve a microstructure of the composite layer and the overall compactness of microcrystalline grains, such that a catalytic metal phase remaining in a diamond composite layer during the high-temperature and high-pressure synthesis process has finer pore spaces and thus makes it more difficult to be contacted by a chemical reagent used to leach the metal phase, resulting in more difficult to achieve the required thermal stability than before. The significant increase in the time required for this critical treatment process poses tremendous pressure on a production cycle of a PDC manufacturer and a drill bit manufacturer to manufacture an end product. While improving the dissolution and leaching of a metal phase in a diamond composite layer by a chemical reagent, how to protect a hard alloy substrate under the composite layer has become an important technical task to improve the overall efficiency and safety. The market is in urgent need of a mature and stable technology that can adapt to demanding chemical corrosion conditions to meet production requirements.

SUMMARY

In order to solve the above-mentioned problems, the present disclosure provides a sealed cobalt leaching device, a reagent for the cobalt leaching, a method using the device, and use of the method.

According to a first aspect of the present disclosure, a sealed cobalt leaching device is provided, including a base, where a top of the base is provided with a first groove; a chemical solution holding tool is provided above the base; a bottom of the chemical solution holding tool is removably connected to the base; a holding through-hole penetrating up and down is formed inside the chemical solution holding tool; and a sealing cover is provided above the chemical solution holding tool.

Through the combination of the base, the chemical solution holding tool, and the sealing cover, the holding through-hole inside the chemical solution holding tool is sealed. Moreover, a PDC is placed in the first groove, such that only a diamond layer of the PDC is in contact with a cobalt leaching reagent, thereby effectively protecting a metal alloy substrate.

Further, a first circular groove may be formed downwards at the top of the base; the first groove may be provided at a bottom surface of the first circular groove; and the bottom of the chemical solution holding tool may be connected to the first circular groove through a thread, a clamping groove, a hinge, or an external fixture, and preferably through the thread.

The bottom of the chemical solution holding tool may be connected to the first circular groove through the thread to further improve sealing performance of a connection at the bottom of the chemical solution holding tool.

Further, a second circular groove may be formed upwards at a bottom of the sealing cover; and the sealing cover and the chemical solution holding tool may be connected through a thread, a clamping groove, a hinge, or an external fixture, and preferably through the thread.

The sealing cover and the chemical solution holding tool may be connected through the thread to further improve the sealing performance of a connection at the top of the chemical solution holding tool.

Further, a second circular groove may be formed upwards at a bottom of the sealing cover; and the second circular groove may be connected to an outer peripheral side of the base through a thread, a clamping groove, a hinge, or an external fixture, and preferably through the thread.

The sealing cover and the base may be directly connected through the thread, and when tightening the thread, the sealing cover and the base will squeeze the chemical solution holding tool from the top and the bottom respectively to achieve a prominent sealing effect.

Further, a sealing gasket may be provided between the chemical solution holding tool and the sealing cover; a bottom surface of the sealing gasket may be provided with a sealing bump; the sealing bump and the holding through-hole may be in an interference fit; and a tapered chamfer may be formed at a top of the holding through-hole.

The sealing gasket and the sealing bump that is in interference fit with the holding through-hole can further improve the sealing performance at the top of the chemical solution holding tool, and the tapered chamfer at the top of the holding through-hole facilitates the process that the sealing bump slides into the holding through-hole when the sealing cover is tightened.

Further, a stepped groove may be formed around the first groove on the bottom surface of the first circular groove; a bottom surface of the stepped groove may be provided with a tapered slope, and an included angle between the tapered slope and a vertical direction may be 0° to 45° and preferably 10° to 30°; a bottom surface of the chemical solution holding tool may be provided with a protruding pressing block; a sealing element may be provided inside the stepped groove; and a height of the stepped groove may be less than or equal to a sum of a height of the sealing element and a height of the protruding pressing block at the bottom of the chemical solution holding tool.

When the chemical solution holding tool is tightened, the pressing block squeezes the sealing element downwards to give the sealing element a downward force. Moreover, because the bottom surface of the stepped groove is a tapered slope, the tapered slope will also give the sealing element an oblique upward force. A combined force of these two forces will push the sealing element towards a center, such that the sealing element is close to a PDC to achieve a prominent sealing effect.

Further, a liquid inlet and a liquid outlet may be formed on a side wall of the chemical solution holding tool; the liquid inlet may be formed on a lower part of an inner side wall of the holding through-hole; and the liquid outlet may be formed on an upper part of the inner side wall of the holding through-hole.

The liquid inlets and liquid outlets of multiple chemical solution holding tools may be connected through liquid-conveying pipes to realize the external recycling of a cobalt leaching reagent, which improves the utilization efficiency of the cobalt leaching reagent and the cobalt leaching efficiency. The cobalt leaching reagent may be injected from the liquid inlet at a lower position and then flow out from the liquid outlet at a higher position, which can reduce a cobalt concentration at a junction between a PDC fixture and the cobalt leaching reagent, thereby improving the mass transfer efficiency and then enhancing the cobalt leaching efficiency.

Further, the base and the sealing cover may be made of an organic material and/or an inorganic material;

the organic material may include one or more from the group consisting of an engineering plastic, a rubber, a fluorine-containing plastic, and a resin; and the inorganic material may include one or more from the group consisting of a metal, a metal oxide or nitride, a non-metal, and a non-metal oxide or nitride.

Further, the chemical solution holding tool may be made of an organic material and/or an inorganic material;

the organic material may include one or more from the group consisting of an engineering plastic, a fluorine-containing plastic, and a resin; and the inorganic material may include one or more from the group consisting of a metal, a metal oxide or nitride, a non-metal, and a non-metal oxide or nitride.

Due to the strong corrosivity of the cobalt leaching reagent, the selection of a corrosion-resistant material to fabricate the chemical solution holding tool can increase a life of the fixture.

Further, a material used for the base, the chemical solution holding tool, or the sealing cover may have a Young's modulus of greater than 2.3 GPa;

preferably, the material may have a Young's modulus of greater than 50 GPa; and preferably, the material may have a Young's modulus of greater than 200 GPa.

The three modulus values of 2.3 GPa, 50 GPa, and 200 GPa correspond to the strength of the engineering plastic, metal alloy, and metal oxide ceramic, respectively. Based on the strength requirements and costs of different materials, different materials can be selected as raw materials for fabricating the chemical solution holding tool.

Further, an inner wall of the holding through-hole of the chemical solution holding tool may be provided with a corrosion-resistant layer; a material for fabricating the corrosion-resistant layer may include one or more from the group consisting of a fluorine-containing plastic, a resin, a metal and an oxide or nitride thereof, and a non-metal and an oxide or nitride thereof; and the corrosion-resistant layer may be connected to the chemical solution holding tool through a welding, an adhesive connection, a mechanical connection, or a chemical bonding.

Compared with the use of the corrosion-resistant material to fabricate the entire chemical solution holding tool, the combination of a metal alloy substrate and a corrosion-resistant layer has lower cost and better processability.

Further, the sealing gasket and the sealing element may be made of a corrosion-resistant material; and the corrosion-resistant material may include one or more from the group consisting of a fluororubber, an oxyfluoride rubber, a fluorine-containing plastic, and a fluorine-containing resin.

Further, a CTE of the material of the sealing element or the sealing gasket may be both more than three times and preferably more than five times a maximum CTE of the material of the base, the chemical solution holding tool, and the sealing cover.

When the sealed cobalt leaching device is heated, in order to improve the sealing performance thereof, materials with large CTE are selected as the material of the sealing gasket and the sealing element, such that when a temperature and a pressure inside the holding through-hole increase, the sealing gasket and the sealing element expand accordingly, thereby improving the sealing performance.

According to a second aspect of the present disclosure, a cobalt leaching method is provided, including the following steps:

S1. placing the fixture in the first groove, and then placing the sealing element in the stepped groove;

S2. connecting the chemical solution holding tool and the base, and compacting the sealing element;

S3. injecting the cobalt leaching reagent;

S4. placing the sealing gasket at the top of the chemical solution holding tool, and then assembling the sealing cover to compact the sealing gasket;

S5. heating the assembled sealed cobalt leaching device at 50° C. to 350° C.;

S6. taking out the heated sealed cobalt leaching device, and then cooling it to room temperature;

S7. opening the sealing cover and removing the sealing gasket;

S8. removing the cobalt leaching reagent, and then cleaning an encapsulation layer several times with clean water to remove the residual chemical solution;

S9. removing the chemical solution holding tool and the sealing element, and taking a cobalt-leached fixture out from the first groove; and S10. detecting a cobalt leaching depth of the fixture.

The above cobalt leaching method can achieve high-pressure sealing of a cobalt leaching process of the fixture, which can improve a cobalt leaching temperature and cobalt leaching efficiency, and can also prevent an acid in a cobalt leaching reagent from volatilizing, which may result in polluting the environment, and damaging the human body.

Further, the heating in S5 may be conducted at 70° C. to 250° C. and preferably at 170° C.

Further, a heating method in S5 may include one or more from the group consisting of a water bath, an oil bath, a gas bath, microwave heating, resistance wire heating, oven heating, electromagnetic induction heating, and infrared heating.

Further, in S5, a cobalt leaching time may be adjusted according to a cobalt leaching time-depth curve, such that a thickness of a layer without cobalt leaching remaining in a diamond layer is greater than 300 μm.

The cobalt leaching depth of the diamond layer is controlled. When the thickness of the layer without cobalt leaching remaining in the diamond layer is less than 300 μm, the cobalt leaching reagent has the risk of infiltrating into the metal alloy substrate layer.

Further, in S2, the chemical solution holding tool may be screwed into the base.

Further, in S2, a torque wrench may be used to screw the chemical solution holding tool into the base.

The chemical solution holding tool may be tightened with the torque wrench, such that a screwing degree of the chemical solution holding tool can be adjusted to adjust a deformation degree of the sealing gasket, thereby adjusting an area of a side surface of the PDC exposed to the cobalt leaching reagent to adjust a shape of the cobalt leaching layer.

Further, in S3, the cobalt leaching reagent may be injected into the holding through-hole from the top thereof.

Compared with a method of immersing a PDC downwards in a cobalt leaching reagent, pouring the cobalt leaching reagent on the top of the PDC can stabilize the cobalt leaching process and make an obtained cobalt leaching layer more uniform.

Further, in S3, an injection device may be used to inject the cobalt leaching reagent into the holding through-hole.

Injecting the cobalt leaching reagent through the injection device can prevent the volatilization of the cobalt leaching reagent from affecting the cobalt leaching effect, and can also prevent the cobalt leaching reagent from dripping on the outside of the tool and corroding the tool.

Further, in S8, the cobalt leaching reagent may be removed by overturning the fixture.

Further, in S8, a liquid pump may be used to pump out the cobalt leaching reagent in the holding through-hole.

Compared with the method of overturning the tool, pumping out the cobalt leaching reagent in the holding through-hole can prevent the cobalt leaching reagent from spattering, which may result in polluting the environment, damaging the human body, or corroding the tool.

Further, after S8 and before S9, the cobalt leaching method may further include the following step:

S8.1. cleaning the sealed cobalt leaching device in an ultrasonic cleaning device.

Ultrasonic cleaning can clean away the cobalt leaching reagent in gaps of the sealed cobalt leaching device, and prevent the cobalt leaching reagent from contacting and corroding the metal alloy substrate when the PDC is removed.

Further, after S9 and before S10, the cobalt leaching method may further include the following steps:

S9.1. subjecting the PDC to ultrasonic cleaning.

The ultrasonic cleaning for the PDC can remove the residual cobalt leaching reagent on a diamond skeleton in the cobalt leaching layer.

Further, after S9.1 and before S10, the cobalt leaching method may further include the following step:

S9.2. drying the PDC.

Drying the PDC can allow the residual cobalt leaching reagent on the diamond skeleton to completely volatilize.

Further, after S2 and before S3, the cobalt leaching method may further include the following step:

S2.1. connecting a liquid inlet of one of two adjacent cobalt leaching devices with a liquid outlet of the other one of the two adjacent cobalt leaching devices, and connecting a liquid inlet of the first cobalt leaching device and a liquid outlet of the last cobalt leaching device to an external liquid circulation system, separately.

The liquid inlets and liquid outlets of multiple chemical solution holding tools may be connected through liquid-conveying pipes to realize external recycling of the cobalt leaching reagent, which improves the utilization efficiency of the cobalt leaching reagent and the cobalt leaching efficiency. A cobalt leaching reagent may be injected from a liquid inlet at a lower position and then flow out from a liquid outlet at a higher position, which can reduce a cobalt concentration at a junction between the PDC and the cobalt leaching reagent, thereby improving the mass transfer efficiency and then enhancing the cobalt leaching efficiency.

Further, in S3, an amount of the cobalt leaching reagent may be used of ⅕ to ⅘ of a volume of the holding through-hole.

Because the cobalt leaching reagent includes volatile acid and water, the vaporization of a liquid will cause an internal pressure of the chemical solution holding tool to increase sharply during a heating process. When the amount of the cobalt leaching reagent is more than ⅘ of the volume of the holding through-hole, the remaining ⅕ of the volume is not enough to hold the vaporized cobalt leaching reagent and the internal pressure will exceed a pressure that the sealed cobalt leaching device can withstand, causing the cobalt leaching reagent to overflow or the sealed cobalt leaching device to burst. When the amount of the cobalt leaching reagent is less than ⅕ of the volume of the holding through-hole, the amount of the cobalt leaching reagent is not enough to achieve a target cobalt leaching depth.

According to a third aspect of the present disclosure, a cobalt leaching reagent is provided, including, in parts by mass: 24 to 48 parts of hydrofluoric acid (HF), 24 to 30 parts of nitric acid ($HNO_3$), and 32 to 40 parts of distilled water ($H_2O$).

Further, the cobalt leaching reagent may include, in parts by mass: 36 parts of hydrofluoric acid (HF), 27.2 parts of nitric acid ($HNO_3$), and 36.8 parts of distilled water ($H_2O$).

According to a fourth aspect of the present disclosure, use of the cobalt leaching method described above on a PDC is provided.

The present disclosure has the following beneficial effects:

1. Through the combination of the base, the chemical solution holding tool, and the sealing cover, the holding through-hole inside the chemical solution holding tool is sealed. Moreover, the PDC is placed in the first groove, such that only the diamond layer of the PDC is in contact with the cobalt leaching reagent, thereby effectively protecting the metal alloy substrate.

2. The bottom of the chemical solution holding tool may be connected to the first circular groove through the thread to further improve the sealing performance of the connection at the bottom of the chemical solution holding tool.

3. The sealing cover and the chemical solution holding tool may be connected through the thread to further improve the sealing performance of the connection at the top of the chemical solution holding tool.

4. The sealing cover and the base may be directly connected through the thread, and when tightening the thread, the sealing cover and the base will squeeze the chemical solution holding tool from the top and the bottom respectively to achieve a prominent sealing effect.

5. The sealing gasket and the sealing bump that is in interference fit with the holding through-hole can further improve the sealing performance at the top of the chemical solution holding tool, and the tapered chamfer at the top of the holding through-hole facilitates the process that the sealing bump slides into the holding through-hole when the sealing cover is tightened.

6. When the chemical solution holding tool is tightened, the pressing block squeezes the sealing element downwards to give the sealing element a downward force. Moreover, because the bottom surface of the stepped groove is a tapered slope, the tapered slope will also give the sealing element an oblique upward force. A combined force of these two forces will push the sealing element towards a center, such that the sealing element is close to the PDC to achieve a prominent sealing effect.

7. By integrating the sealing gasket and the sealing cover into one fixture, operation steps for disassembling and assembling the fixture are simplified to improve the efficiency.

8. Due to the strong corrosivity of the cobalt leaching reagent, the selection of the corrosion-resistant material to fabricate the chemical solution holding tool can increase the life of the fixture.

9. Compared with the use of the corrosion-resistant material to fabricate the entire chemical solution holding tool, the combination of the metal alloy substrate and the corrosion-resistant layer has lower cost and better processability.

10. When the sealed cobalt leaching device is heated, in order to improve the sealing performance, materials with large CTE are selected as the material of the sealing gasket and the sealing element, such that when the temperature and the pressure inside the holding through-hole increase, the sealing gasket and the sealing element expand accordingly, thereby improving the sealing performance.

11. The above cobalt leaching method can achieve high-pressure sealing of a cobalt leaching process of the PDC, which can improve a cobalt leaching temperature and a cobalt leaching efficiency, and can also prevent an acid in the cobalt leaching reagent from volatilizing, which may result in polluting the environment, and damaging the human body.

12. The cobalt leaching depth of the diamond layer is controlled. When the thickness of the layer without cobalt leaching remaining in the diamond layer is less than 300 μm, the cobalt leaching reagent has the risk of infiltrating into the metal alloy substrate.

13. The chemical solution holding tool may be tightened with the torque wrench, such that the screwing degree of the chemical solution holding tool can be adjusted to adjust the deformation degree of the sealing gasket, thereby adjusting an area of the side surface of the PDC exposed to the cobalt leaching reagent to adjust the shape of the cobalt leaching layer.

14. Injecting the cobalt leaching reagent through the injection device can prevent the volatilization of the cobalt leaching reagent from affecting the cobalt leaching effect, and can also prevent the cobalt leaching reagent from dripping on the outside of the tool and corroding the tool.

15. Compared with the method of overturning the tool, pumping out the cobalt leaching reagent in the holding through-hole can prevent the cobalt leaching reagent from spattering, which may result in polluting the environment, damaging the human body, or corroding the tool.

16. Ultrasonic cleaning can clean away the cobalt leaching reagent in the gaps of the tool, and prevent the cobalt leaching reagent from contacting and corroding the metal alloy substrate when the PDC is removed.

17. The ultrasonic cleaning for the PDC can remove the residual cobalt leaching reagent on the diamond skeleton in the cobalt leaching layer.

18. Drying the PDC can allow the residual cobalt leaching reagent on the diamond skeleton to completely volatilize.

19. Because the cobalt leaching reagent includes a volatile chemical composition and water, the vaporization of the liquid will cause an internal pressure of the chemical solution holding tool to increase sharply during a heating process. When the amount of the cobalt leaching reagent is more than ⅘ of the volume of the holding through-hole, the remaining ⅕ of the volume is not enough to hold the vaporized cobalt leaching reagent and the internal pressure will exceed a pressure that the sealed cobalt leaching device can withstand, causing the cobalt leaching reagent to overflow or the sealed cobalt leaching device to burst. When the amount of the cobalt leaching reagent is less than ⅕ of the volume of the holding through-hole, the amount of the cobalt leaching reagent is not enough to achieve a target cobalt leaching depth.

20. The liquid inlets and liquid outlets of multiple chemical solution holding tools may be connected through liquid-conveying pipes to realize the external recycling of the cobalt leaching reagent, which improves the utilization efficiency of the cobalt leaching reagent and the cobalt leaching efficiency. The cobalt leaching reagent may be injected from a liquid inlet at a lower position and then flow out from a liquid outlet at a higher position, which can reduce the cobalt concentration at a junction between the PDC and the cobalt leaching reagent, thereby improving the mass transfer efficiency and then enhancing the cobalt leaching efficiency.

21. The three modulus values of 2.3 GPa, 50 GPa, and 200 GPa correspond to the strength of the engineering plastic, metal alloy, and metal oxide ceramic, respectively. Based on the strength requirements and costs of different materials, different materials can be selected as raw materials for fabricating the chemical solution holding tool.

22. Compared with a method of immersing the PDC downwards in the cobalt leaching reagent, pouring the cobalt leaching reagent on the top of the PDC can stabilize the cobalt leaching process and make an obtained cobalt leaching layer more uniform.

Figure 1:
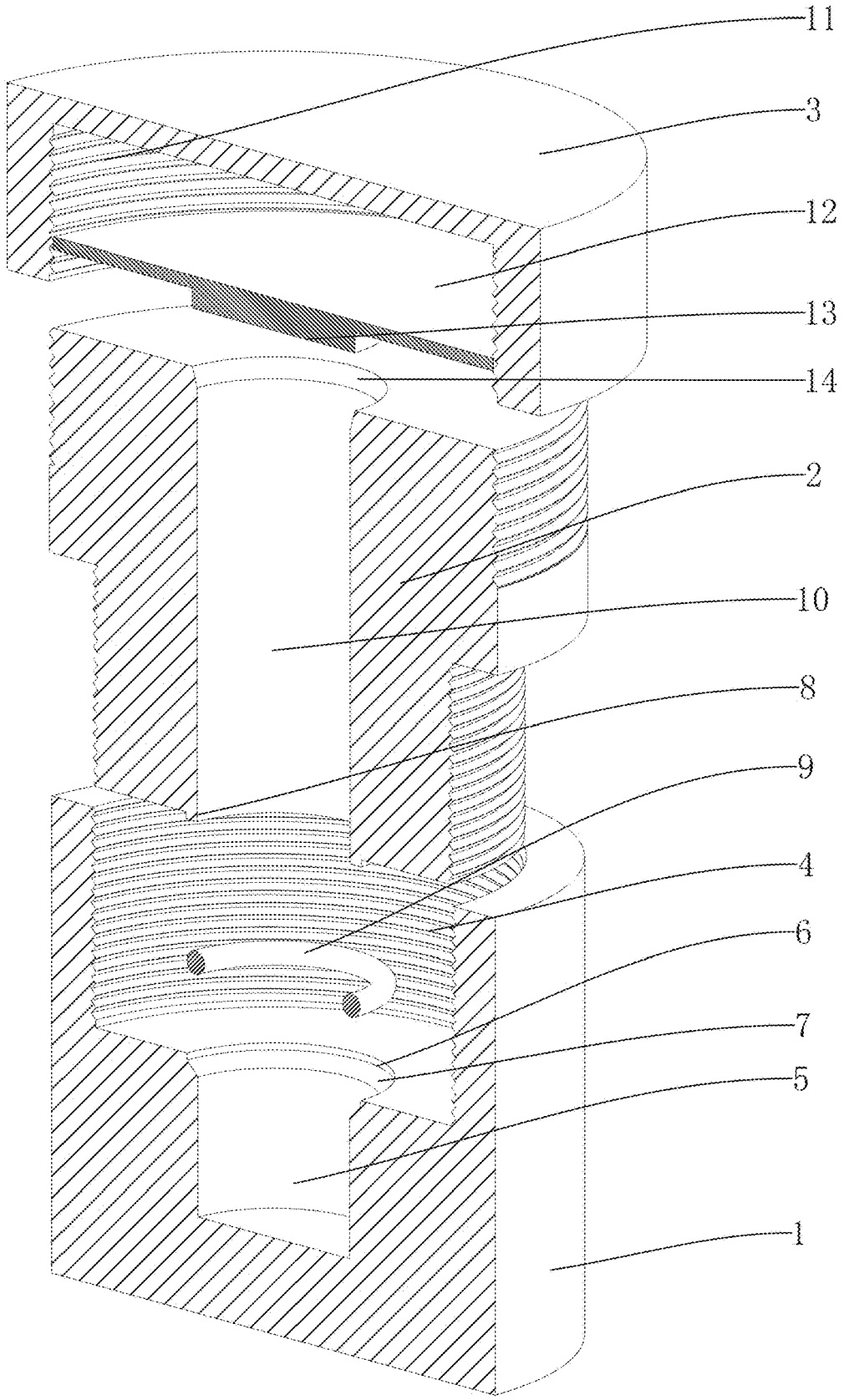
FIG. 1 is a schematic structural diagram of a sealed cobalt leaching device of Example 1.

Reference numerals: base 1; chemical solution holding tool 2; sealing cover 3; first circular groove 4; first groove 5; stepped groove 6; tapered slope 7; protruding pressing block 8; sealing element 9; holding through-hole 10; second circular groove 11; sealing gasket 12; sealing bump 13; tapered chamfer 14; liquid inlet 15; liquid outlet 16; pipe 17; channel 18; cobalt leaching layer 19; layer without cobalt leaching 20; and metal alloy substrate 21.

DETAILED DESCRIPTION

In order to enable those skilled in the art to better understand the solutions of the present disclosure, the technical solutions in the examples of the present disclosure will be described clearly and completely below in conjunction with the accompanying drawings of the specification of the present disclosure. When an "example" is mentioned herein, specific features, structures, or characteristics described in conjunction with the example may be included in at least one example of the present disclosure. The phrase appearing in different parts of the specification does not necessarily refer to the same example or an independent or alternative example exclusive of other examples. It may be explicitly or implicitly appreciated by those skilled in the art that the example described herein may be combined with other examples.

EXAMPLE 1

As shown in FIG. 1, a sealed cobalt leaching device is provided, including a base 1, a chemical solution holding tool 2, and a sealing cover 3, where a first circular groove 4 is formed downwards at a top of the base 1; a first groove 5 is formed downwards on a bottom surface of the first circular groove 4; a stepped groove 6 is formed around the first groove 5 on the bottom surface of the first circular groove 4; a tapered slope 7 is provided at a bottom surface of the stepped groove 6, and an included angle between the tapered slope 7 and a vertical direction is 30°; a bottom surface of the chemical solution holding tool 2 is provided with a protruding pressing block 8 that matches with the stepped groove 6; a sealing element 9 is provided inside the stepped groove 6; a height of the stepped groove 6 is smaller than a thickness of the sealing element 9; a bottom of the chemical solution holding tool 2 is threadedly connected to the first circular groove 4; a holding through-hole 10 penetrating up and down is formed inside the chemical solution holding tool 2; the sealing cover 3 is provided above the chemical solution holding tool 2; a second circular groove 11 is formed upwards at a bottom of the sealing cover 3; the sealing cover 3 is threadedly connected to the chemical solution holding tool 2; a sealing gasket 12 is provided between the chemical solution holding tool 2 and the sealing cover 3; a sealing bump 13 is provided on a bottom surface of the sealing gasket 12; the sealing bump 13 and the holding through-hole 10 are in an interference fit; and a tapered chamfer 14 is formed at a top of the holding through-hole 10.

The base 1, the chemical solution holding tool 2, and the sealing cover 3 are made of an engineering plastic with a Young's modulus of 2.3 GPa, and an inner side of the base 1, an inner side wall of the holding through-hole, and an inner side of the sealing cover are each coated with a fluorine-containing plastic lining. The sealing gasket 12 and the sealing element 9 are made of a fluororubber, which has a CTE that is three times larger than that of the material of the base 1, the chemical solution holding tool 2, and the sealing cover 3.

Through the combination of the base, the chemical solution holding tool, and the sealing cover, the holding through-hole inside the chemical solution holding tool is sealed. Moreover, a PDC is placed in the first groove, such that only a diamond layer of the PDC is in contact with a cobalt leaching reagent, thereby effectively protecting a metal alloy substrate.

Figure 2:
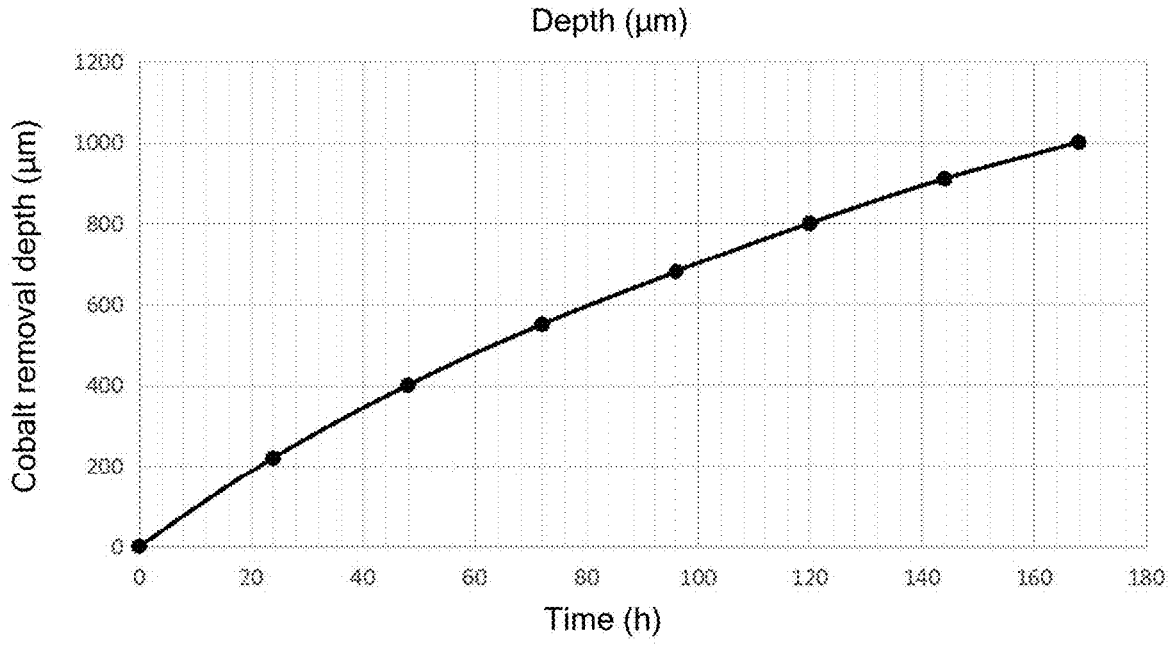
FIG. 2 is a graph illustrating a relationship between a cobalt leaching depth and a cobalt leaching time.

A specific method for leaching cobalt from the PDC is as follows:

A cobalt leaching method includes the following steps:

S1. the PDC is placed in the first groove 5, and then the sealing element 9 is placed in the stepped groove 6;

S2. a torque wrench is used to screw the chemical solution holding tool 2 into the base 1, and the sealing element 9 is compacted;

S3. a syringe is used to inject the cobalt leaching reagent from the top of the holding through-hole 10 with an amount of ⅔ of a volume of the holding through-hole 10, where the cobalt leaching reagent includes, in parts by mass: 36 parts of hydrofluoric acid (HF), 27.2 parts of nitric acid ($HNO_3$), and 36.8 parts of distilled water ($H_2O$);

S4. the sealing gasket 12 is placed at a top of the chemical solution holding tool 2, and the sealing cover 3 is tightened to compact the sealing gasket 12;

S5. as shown in FIG. 2, the assembled sealed cobalt leaching device is heated in an oil bath at 170° C. for 72 h, such that a thickness of the remaining layer without cobalt leaching 20 in the diamond layer is greater than 300 μm;

S6. the heated sealed cobalt leaching device is taken out and then cooled to room temperature;

S7. the sealing cover 3 is unscrewed and the sealing gasket 12 is removed;

S8. the cobalt leaching reagent in the holding through-hole 10 is pumped out with a liquid pump, then an encapsulation layer is cleaned several times with clean water to remove a residual chemical solution, and the tool is cleaned in an ultrasonic cleaning device;

S9. the chemical solution holding tool 2 is unscrewed, the sealing gasket 12 is removed, and then the cobalt-leached PDC is taken out from the first groove 5, ultrasonically cleaned, and dried; and S10. a cobalt leaching depth of the diamond layer in the PDC is detected.

Figure 3:
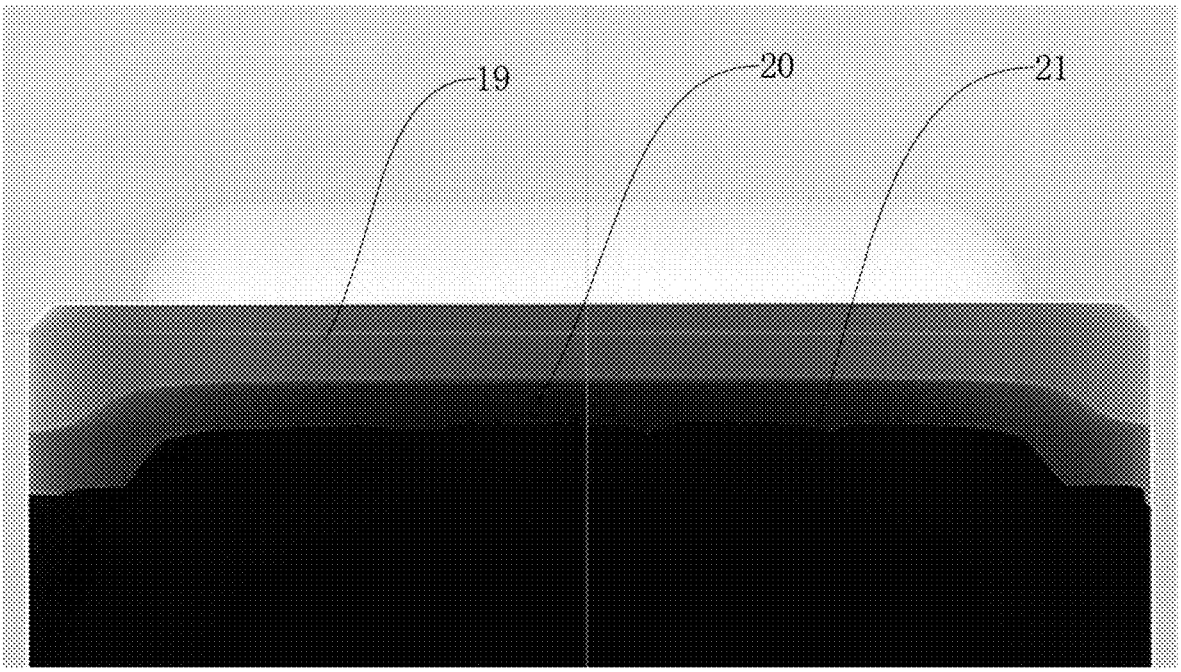
FIG. 3 shows a cobalt leaching effect of a PDC under X-rays.

The above cobalt leaching method can achieve high-pressure sealing of a cobalt leaching process of the PDC, which can improve a cobalt leaching temperature and a cobalt leaching efficiency, and can also prevent an acid in the cobalt leaching reagent from volatilizing, which may result in polluting the environment, and damaging the human body. Compared with a method of immersing the PDC downwards in the cobalt leaching reagent, pouring the cobalt leaching reagent on the top of the PDC can stabilize the cobalt leaching process to make an obtained cobalt leaching layer 19 more uniform, and can also prevent the cobalt leaching reagent from infiltrating into the metal alloy substrate 21, as shown in FIG. 3.

EXAMPLE 2

Figure 4:
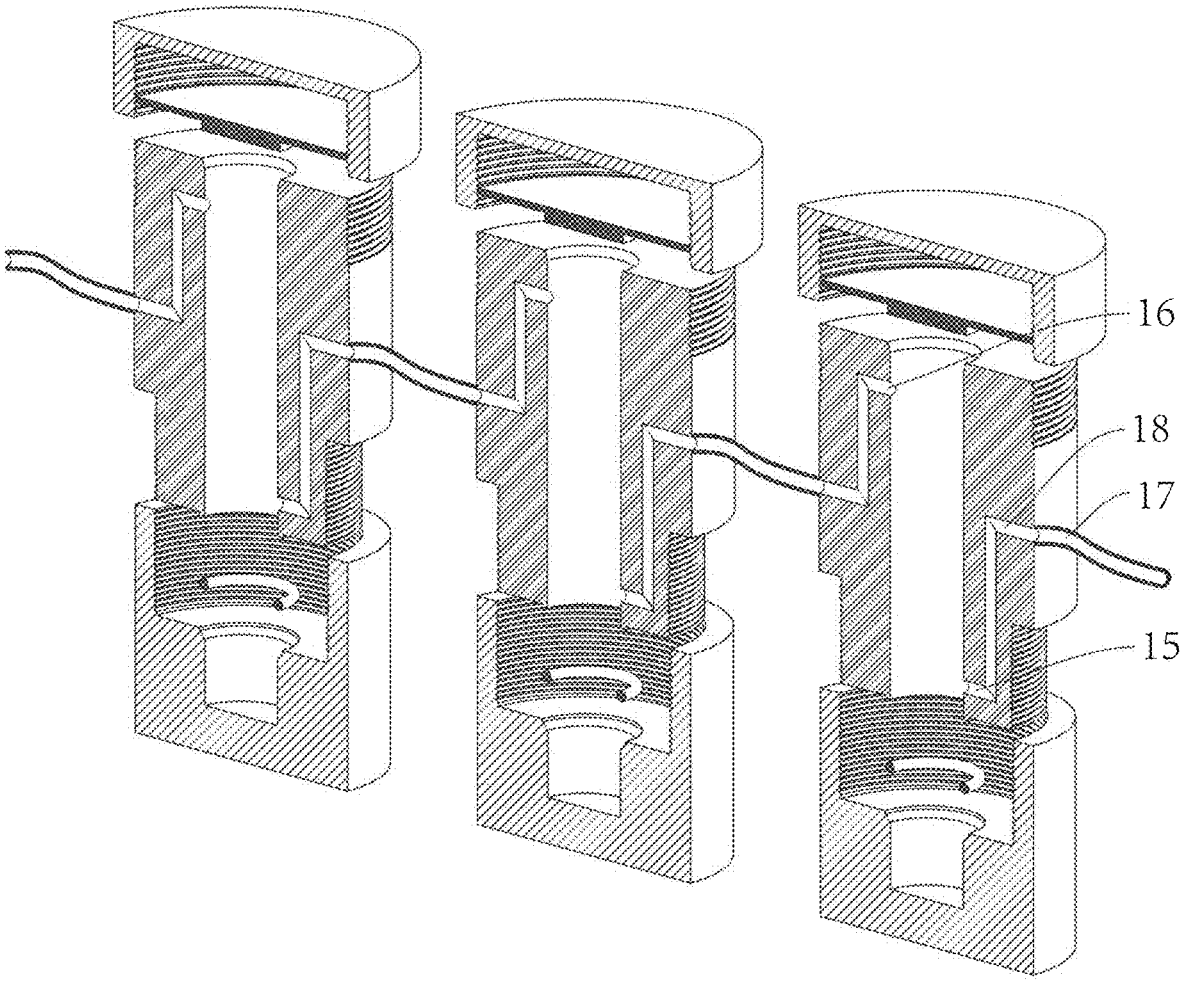
FIG. 4 is a schematic structural diagram of a sealed cobalt leaching device of Example 2.

On the basis of Example 1, as shown in FIG. 1 and FIG. 4, a liquid inlet 15 and a liquid outlet 16 are formed on each of inner side walls of three chemical solution holding tools 2; the liquid inlet 15 is formed on a lower part of a right inner side wall of the holding through-hole 10; the liquid outlet 16 is formed on an upper part of the left inner side wall of the holding through-hole 10; a channel 18 is provided inside the chemical solution holding tool 2, such that the liquid inlet 15 and the liquid outlet 16 communicate with the outside, separately; a pipe 17 is provided between two adjacent chemical solution holding tools 2 to connect the three chemical solution holding tools 2 in series and make the three chemical solution holding tools connected to an external liquid circulation device such as a circulating pump through the leftmost pipe 17 and the rightmost pipe 17.

When the device disclosed in Example 2 is in use, compared with Example 1, after the chemical solution holding tool 2 is screwed on the base 1, a liquid inlet 15 of one of two adjacent cobalt leaching devices is connected to a liquid outlet 16 of the other one of the two adjacent cobalt leaching devices through the channel 18 and the pipe 17, and then a liquid inlet 15 of the first cobalt leaching device and a liquid outlet 16 of the last cobalt leaching device are connected to an external liquid circulation system, separately; and during the cobalt leaching process, the circulating pump is used to continuously pump the cobalt leaching reagent in from the right pipe 17 and make it flow into a waste liquid pool from the left pipe 17. However, since the cobalt leaching reagent will react with PDCs from right to left successively, the concentration of the cobalt leaching reagent will gradually decrease.

For a continuous cobalt leaching process in which the circulating pump continuously pumps the cobalt leaching reagent in, the PDC on the right side has higher cobalt leaching efficiency. The more the number of the chemical solution holding tools 2 in series, the greater the difference of the cobalt leaching depth between the first and the last PDC. Therefore, 3 to 5 and preferably 3 chemical solution holding tools are generally connected in series, such that the cobalt leaching depth can be controlled. When the number of the chemical solution holding tools in series is greater than 5, it is necessary to calculate a cobalt leaching rate at different cobalt leaching reagent concentration, and in combination with a cobalt leaching time-depth curve, the PDCs are removed from right to left successively to ensure the uniformity of cobalt leaching depth.

Intermittent cobalt leaching is a more common method, where a circulating pump is used to pump the cobalt leaching reagent into the chemical solution holding tool 2; after a period of cobalt leaching, the circulating pump is turned on once again to completely replace the cobalt leaching reagent in the chemical solution holding tool 2, and then the cobalt leaching is continued; and in this way, the cobalt leaching depth can be controlled to make a cobalt leaching depth of each PDC more uniform.

The liquid inlets 15 and liquid outlets 16 of multiple chemical solution holding tools 2 are connected through liquid-conveying pipes 17 to realize the external recycling of the cobalt leaching reagent, which improves the utilization efficiency of the cobalt leaching reagent and the cobalt leaching efficiency. The cobalt leaching reagent may be injected from the liquid inlet 15 at a lower position and then flow out from the liquid outlet 16 at a higher position, which can reduce a cobalt concentration at a junction between the PDC and the cobalt leaching reagent, thereby improving the mass transfer efficiency and enhancing the cobalt leaching efficiency.

The above-mentioned examples are only preferred examples of the present disclosure and do not limit the technical solutions of the present disclosure. Any technical solutions that can be implemented on the basis of the above-mentioned examples without creative efforts shall be regarded as falling within the protection scope of the present disclosure.

What is claimed is:

1. A sealed cobalt leaching device, comprising a base, a top of which is provided with a first groove, wherein a chemical solution holding tool is provided above the base, a bottom of the chemical solution holding tool is removably connected to the base, a holding through-hole penetrating up and down is formed inside the chemical solution holding tool, a sealing cover is provided above the chemical solution holding tool;

a first circular groove is formed downwards at the top of the base, the first groove is provided at a bottom surface of the first circular groove, the bottom of the chemical solution holding tool is connected to the first circular groove through a thread, a clamping groove, a hinge, or an external fixture;

a second circular groove is formed upwards at a bottom of the sealing cover, the sealing cover and the chemical solution holding tool are connected through a thread, a clamping groove, a hinge, or a external fixture, and the second circular groove and an outer perimeter of the base are connected through a thread, a clamping groove, a hinge, or a external fixture;

wherein a sealing gasket is provided between the chemical solution holding tool and the sealing cover, a bottom surface of the sealing gasket is provided with a sealing bump, the sealing bump and the holding through-hole are in an interference fit, and a tapered chamfer is formed at a top of the holding through-hole.

2. The sealed cobalt leaching device according to claim 1, wherein a stepped groove is formed around the first groove on the bottom surface of the first circular groove; a bottom surface of the stepped groove is provided with a tapered slope, and an included angle between the tapered slope and a vertical direction is 0° to 45°; a bottom surface of the chemical solution holding tool is provided with a protruding pressing block; a sealing element is provided inside the stepped groove, and a height of the stepped groove is less than or equal to a sum of a height of the sealing element and a height of the protruding pressing block at the bottom of the chemical solution holding tool.

3. The sealed cobalt leaching device according to claim 2, wherein a liquid inlet and a liquid outlet are formed on a side wall of the chemical solution holding tool, the liquid inlet is formed on a lower part of an inner side wall of the holding through-hole, and the liquid outlet is formed on an upper part of the inner side wall of the holding through-hole.

4. The sealed cobalt leaching device according to claim 2, wherein the base and the sealing cover are made of an organic material and/or an inorganic material;

the organic material comprises one or more from the group consisting of a rubber, a fluorine-containing resin; and the inorganic material comprises one or more from the group consisting of a metal, a metal oxide or nitride, a non-metal, and a non-metal oxide or nitride.

5. The sealed cobalt leaching device according to claim 4, wherein the chemical solution holding tool is made of an organic material and/or an inorganic material;

the organic material comprises a fluorine-containing resin; and the inorganic material comprises one or more from the group consisting of a metal, a metal oxide or nitride, a non-metal, and a non-metal oxide or nitride.

6. The sealed cobalt leaching device according to claim 5, wherein an inner wall of the through-hole of the chemical solution holding tool is provided with a corrosion-resistant layer; the corrosion-resistant layer comprises one or more materials selected from the group consisting of a resin, a metal and an oxide or nitride thereof, and a non-metal and an oxide or nitride thereof; and the corrosion-resistant layer is connected to the chemical solution holding tool through a welding, an adhesive connection, a mechanical connection, or a chemical bonding.

7. The sealed cobalt leaching device according to claim 4, wherein a material used for the base, the chemical solution holding tool, or the sealing cover has a Young's modulus of greater than 2.3 GPa.

8. The sealed cobalt leaching device according to claim 4, wherein the sealing gasket and the sealing element are made of a corrosion-resistant material; and the corrosion-resistant material comprises one or more from the group consisting of a fluororubber, and a fluorine-containing resin.

9. The sealed cobalt leaching device according to claim 8, wherein a coefficient of thermal expansion (CTE) of a material for the sealing element or the sealing gasket is more than three times a maximum CTE of materials of the base, the chemical solution holding tool, and the sealing cover.

* * * * *